US006192107B1

(12) United States Patent
Price et al.

(10) Patent No.: US 6,192,107 B1
(45) Date of Patent: Feb. 20, 2001

(54) LIQUID METAL COOLED ANODE FOR AN X-RAY TUBE

(75) Inventors: Michael J. Price, Brookfield; Paul E. Neitzke, Menomenee Falls, both of WI (US); Mark E. Vermilyea, Miskayana, NY (US); Douglas J. Snyder, Brookfield, WI (US); Carey S. Rogers, Waukesha, WI (US); Eti Ganin, Milwaukee, WI (US); Mark O. Derakhshan, West Allis, WI (US); Stephen S. Waite, Milwaukee, WI (US)

(73) Assignee: General Electric Company, Milwaukee, WI (US)

( * ) Notice: Under 35 U.S.C. 154(b), the term of this patent shall be extended for 0 days.

(21) Appl. No.: 09/275,321

(22) Filed: Mar. 24, 1999

(51) Int. Cl.[7] ..... H01J 35/10
(52) U.S. Cl. ..... 378/130; 378/125
(58) Field of Search ..... 378/130, 125

(56) References Cited

U.S. PATENT DOCUMENTS 5,541,975 * 7/1996 Anderson ..... 378/130

* cited by examiner

*Primary Examiner*—Craig E. Church
(74) *Attorney, Agent, or Firm*—Barbara JoanHaushalter; Christian G. Cabou; Phyllis Y. Price

(57) ABSTRACT

A system and method are proposed for cooling the anode of an X-ray tube. A bearing shaft associated with the anode has an associated single rotating seal there around, and contains a liquid metal. A primary liquid metal flow path is used to transfer heat from the anode, and a secondary liquid metal flow path is provided to seal the single rotating seal. Accordingly, the present invention provides an effective means for containing liquid metal in the bearing shaft of an anode assembly, and using the liquid metal to cool the anode of the X-ray tube.

14 Claims, 2 Drawing Sheets

LIQUID METAL COOLED ANODE FOR AN X-RAY TUBE

BACKGROUND OF THE INVENTION

The present invention relates to X-ray tubes and particularly to a liquid metal cooled anode concept for X-ray tube application.

In the X-ray tube art, conventionally cooled tubes are reaching their limit in power dissipation. Future X-ray tubes will be required to operate under ever-increasing power demands and at noise levels below 55 Db.

Liquid metal may be capable of extracting heat from the anode portion of the X-ray tube, and also possibly allow the bearings to run more quietly. However, technical problems associated with such technology have not been effectively overcome. Furthermore, the cost of manufacture for potential designs can be prohibitive and restrictive.

It would be desirable, then, to be able to apply a liquid metal cooled anode concept to effectively cool X-ray tubes. It would further be desirable to apply such a liquid cooled anode concept which has the effect of increasing the power dissipation of the tube.

BRIEF SUMMARY OF THE INVENTION

Liquid cooled metal technology is used for extracting heat from the anode of an X-ray tube.

A system and method are provided for cooling the anode of an X-ray tube. A bearing shaft associated with the anode has an associated single rotating seal there around, and contains a liquid metal. A primary liquid metal flow path is used to transfer heat from the anode, and a secondary liquid metal flow path is provided to seal the single rotating seal.

Accordingly, the present invention provides an effective means for containing liquid metal in the bearing shaft of an anode assembly, and using the liquid metal to cool the anode of the X-ray tube.

DETAILED DESCRIPTION OF THE INVENTION

The present invention relates to rotating X-ray tubes which employ a rotating anode assembly and a cathode assembly. A liquid metal cooled anode concept is proposed to effectively cool X-ray tubes. The liquid cooled anode concept has the further effect of increasing the power dissipation of the tube. This is accomplished by conducting heat directly from the target, down to the bearing shaft and into the cooling oil in the base of the shaft, the oil being on the air side of the anode. A gallium alloy allows conduction between rotating parts. The heat path from the bearing shaft across the gallium is into the conduction rod and oil via conduction and convection.

Figure 1:
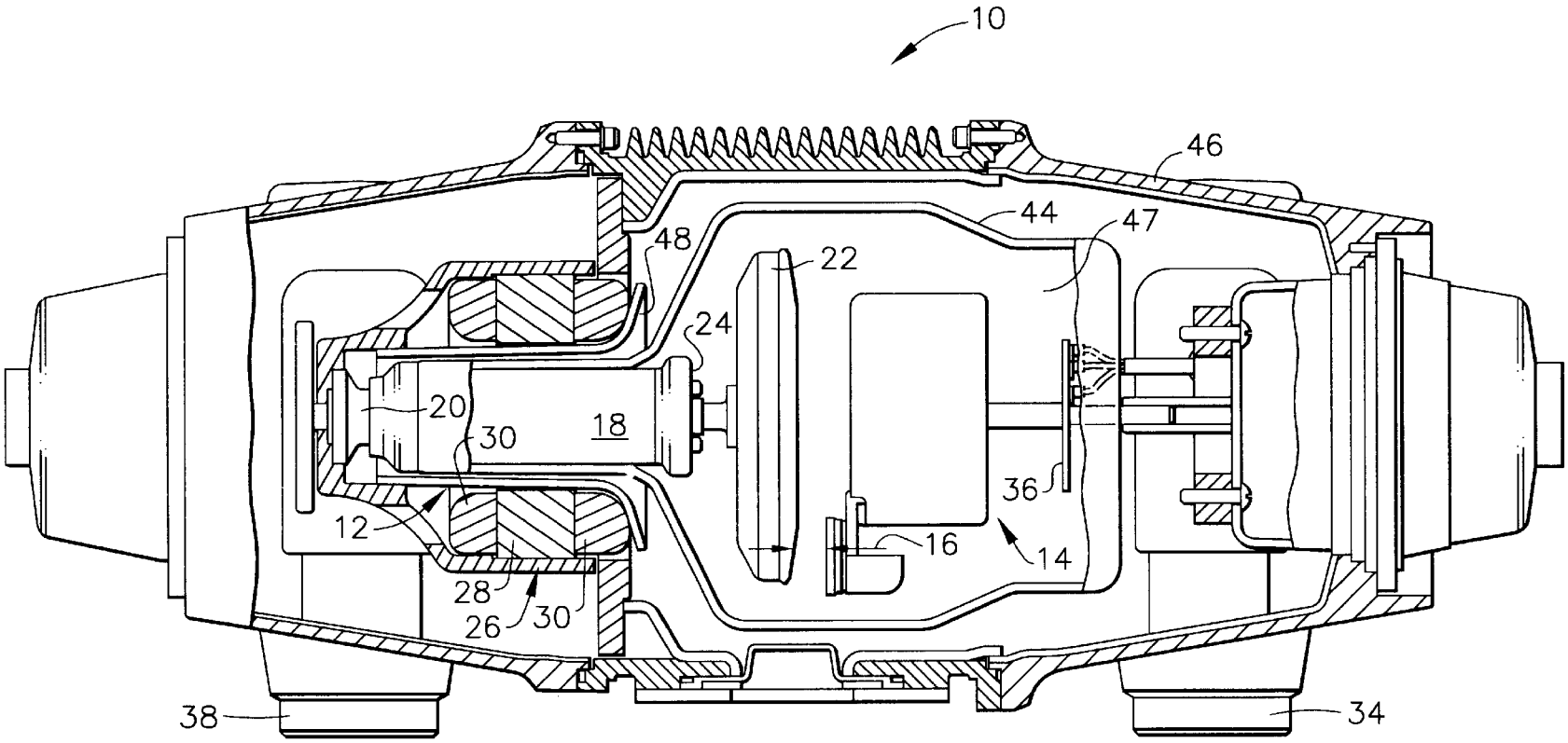
FIG. 1 (PRIOR ART)
FIG. 1 is a prior art cross-sectional illustration of a typical X-ray tube.

Referring now to the drawings, FIG. 1 illustrates a typical prior art X-ray tube 10. The X-ray tube 10 is typically built with a rotating anode assembly 12 for the purpose of distributing the heat generated at a focal spot, and an X-ray tube cathode assembly 14 for providing a focused electron beam which is accelerated across a large anode-to-cathode vacuum gap 16 and produces X-rays upon impact with the anode.

Continuing with FIG. 1, an anode assembly 12 may be rotated by an induction motor typically comprising a cylindrical rotor 18 built around a cantilevered axle 20. The cantilevered axle 20 supports a disc shaped anode target 22 connected via the hub and stud 24 to rotor 18 and cantilevered axle 20 which contains bearings facilitating rotation. The stator 26 of the induction motor includes a ferrous stator core 28 with copper windings 30 that surround the rotor 18. The rotor 18 of the rotating anode assembly 12, driven by the stator 26, is at anodic potential.

The X-ray tube cathode assembly 14 includes a cathode cable receptacle 34 and a cathode terminal board 36 which internally connects the cathode assembly 14 to the receptacle 34. The anode assembly 12 includes an anode cable receptacle 38 which electrically connects the anode to an anode high voltage cable (not shown). In a typical assembly, the anode assembly 12 and the cathode assembly 14 are sealed in a frame 44, thus creating a vacuum region 47, and are mounted in a conductive metal casing 46.

Figure 2:
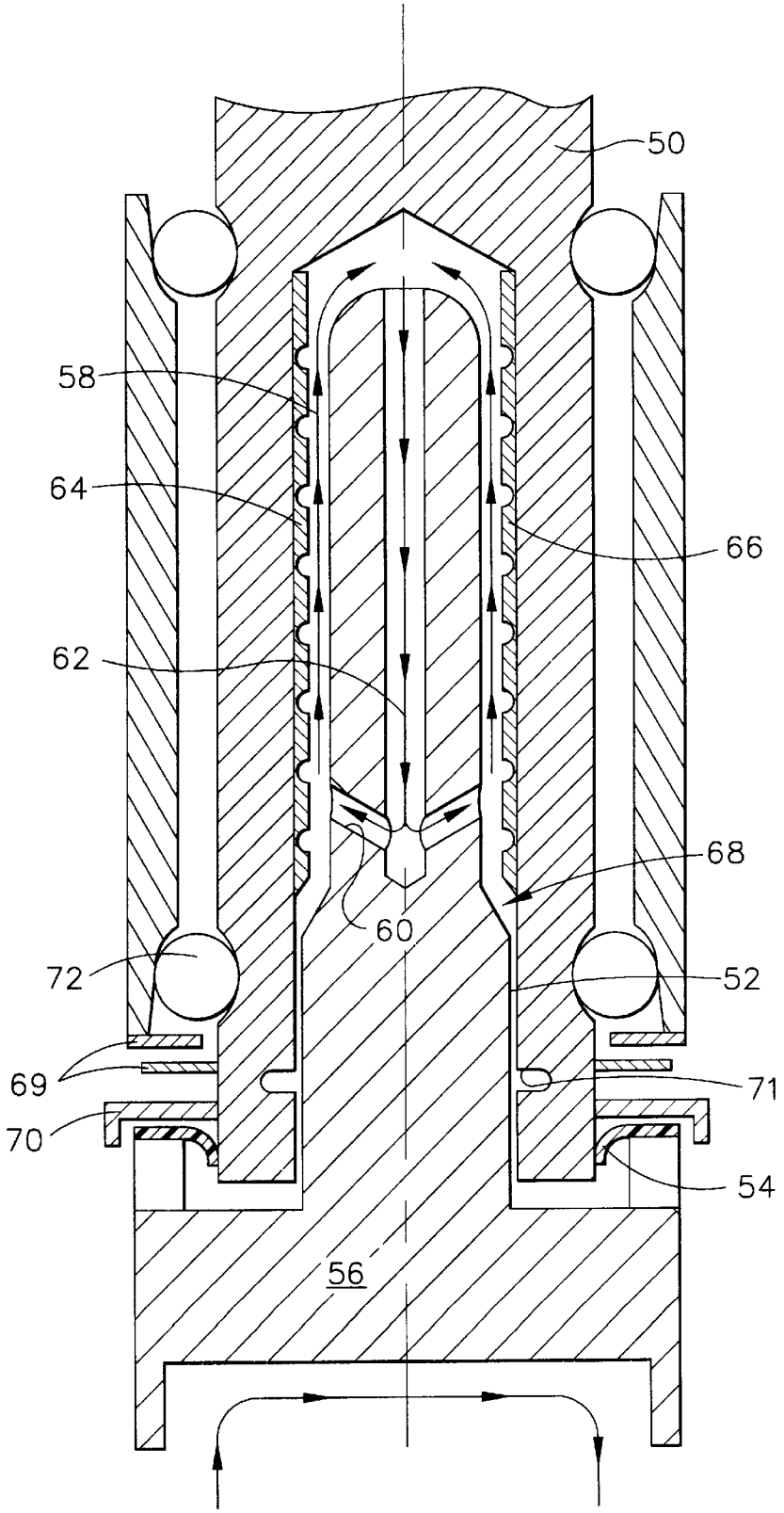
FIG. 2 illustrates a cross-sectional view of an X-ray tube anode assembly incorporating features of the present invention.

Referring now to FIG. 2, an X-ray tube anode assembly provides increased power demands. Liquid metal is used to extract heat from the anode assembly of the X-ray tube, thereby effectively cooling the anode. In particular, the liquid metal, or gallium alloy, is contained in the bearing shaft 50 of the anode assembly.

The liquid metal cooled anode concept illustrated in FIG. 2 comprises one rotating gap seal 52 and a contact seal 54 associated with a conduction rod 56. A channel 62 and exit ports 60 are cut through the conduction rod to facilitate the pumped flow of gallium to mitigate against leakage. A secondary gallium flow path 62 is incorporated to generate a resistance to the primary flow and help seal the rotating seal 52. This dual gallium flow action addresses and solves for numerous of the technical difficulties associated with prior art attempts to apply liquid metal cooling to X-ray tubes.

Effective rotating seals can operate by using differential pressure. However, in a vacuum, such as in the X-ray tube, this cannot be easily accomplished, and sealing the gallium presents unique problems. However, advantage is taken of the rotating bearing shaft 50 to cause a differential pressure effect. This is achieved by machining a thin walled tube 64, with helical grooves or slots 66 formed therein. This tube 64 is inserted into the hollow bore of shaft 50 to create the primary gallium flow zone 58. Channel and exit ports are added in the stationary conduction rod 56 to create the secondary gallium flow zone 62. The rotating seal 52 is thereby aided from leaking due to the difference in pressure across the end of the shaft caused by the channel and exit ports. The channel and exit ports supply a flow of gallium in opposition to the primary gallium flow. The primary gallium flow is created by the pumping action of the helical grooved tube 64 inserted in the hollow bore.

In a preferred embodiment of the present invention, liquid gallium alloy containment can be further enhanced. First, a close clearance region is established by the gap seal 52. In this region, the radial gap between the stationary inner parts 56 and the rotating outer parts 50 is 100 micro meters or less. An anti-wet coat can extend into this region. A larger gap region 68 which is coated with a wetting agent merges with the close gap region 52. Within the small gap, a capillary force is established at the wetted film and anti wetted film boundary. This force is can contain an inertial force of several G's acting on the liquid gallium alloy.

A second enhancement to contain the liquid gallium alloy is the contact seal 54. The contact seal 54 can be employed as a secondary containment of any liquid droplets which escape the interface. This seal 54 can be formed by an annular disk of fluoro-elastomeric compound and placed just behind the rear bearing 72. It will then run against the outer hardened surface of the tubular bearing shaft 50. However, since the seal 54 will trap air, an air extraction feature can be added to allow for the extraction of air from behind the seal during X-ray tube processing. For example, a sintered molybdenum plug may be used, fabricated from appropriately sized molybdenum balls. This can create a porous plug through which the air can be evacuated. Preferably, the porosity is small enough that the gallium will not pass through. Although porous ceramics might be applied, ceramics are more fragile than molybdenum.

A third enhancement to contain the liquid gallium comprises stationary metallic shields 69 attached to the rear bearing assembly, and a metallic disk 70. The metallic disk is a rotating wettable metallic disk. The stationary metallic shields and rotating disk can trap droplets of liquid gallium, and minimize liquid gallium contact with the rear bearing 72. An associated gallium trap 71 can also operate to trap droplets of liquid gallium.

The fill level is set so that during operation, the liquid-vacuum interface is maintained in the large gap region 68. Thus, thermal expansion of the liquid can be tolerated without large movement in the location of the interface. Under steady-state operation, the interface is stable. However, during transient operation, it is expected that liquid droplets will be detached from the interface. These droplets will be reabsorbed into the liquid pool, due to the nature and location of the wetted surfaces. All surfaces in contact with the gallium alloy can be coated with an anti-corrosion coating, if desired. Furthermore, when anode heat is transferred to shaft 50 by conduction and convection through the gallium, bearing operating temperature can be lowered. This allows for the opportunity to use noise dampening lubricants such as lead.

The liquid metal cooled anode concept provides the advantage of preventing gallium leakage during shipment and tube installation. Specifically, the large gap region 68 minimizes the gallium leakage during shipment of the X-ray tube. In the vertical (shipping) position, the gallium is prevented from coming into contact with the rotating seal 52 since it will have a natural tendency to flow into region 68 and be contained.

Gallium leakage is minimized with the application of several features. One advantageous feature is the hollow bearing shaft with the helical grooved tube inserted therein. A primary gallium flow is generated for heat extraction and a secondary gallium flow is generated to oppose the primary flow. This creates a differential pressure to allow the rotating seal to work effectively in a vacuum. A reservoir holds the gallium in the vertical position away from the rotating seal, minimizing gallium leakage. Finally, the seal is outer rotating, which contributes to a decrease in gallium leakage.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An X-ray tube comprising:

an anode assembly;

a bearing shaft associated with the anode assembly, the bearing shaft containing a liquid metal;

a single rotating seal, the single rotating seal being positioned around the bearing shaft;

a primary liquid metal flow path to transfer heat from the anode assembly; and a secondary liquid metal flow path to seal the single rotating seal.

2. An X-ray tube as claimed in claim 1 wherein the liquid metal comprises gallium.

3. An X-ray tube as claimed in claim 1 wherein the liquid metal comprises a gallium alloy.

4. An X-ray tube as claimed in claim 1 wherein the transfer of heat creates a heat path.

5. An X-ray tube as claimed in claim 4 wherein the heat path is from the bearing shaft across the liquid metal.

6. An X-ray tube as claimed in claim 5 wherein the bearing shaft comprises a base that can contain cooling oil.

7. An X-ray tube as claimed in claim 6 wherein the heat path is into a conduction rod and the cooling oil via conduction and convection.

8. A method for cooling the anode of an X-ray tube, comprising the steps of:

providing a bearing shaft associated with the anode, the bearing shaft containing a liquid metal;

positioning a single rotating seal around the bearing shaft;

using a primary liquid metal flow path to transfer heat from the anode; and providing a secondary liquid metal flow path to seal the single rotating seal.

9. A method as claimed in claim 8 wherein the liquid metal comprises gallium.

10. A method as claimed in claim 8 wherein the liquid metal comprises a gallium alloy.

11. A method as claimed in claim 8 wherein the transfer of heat creates a heat path.

12. A method as claimed in claim 11 wherein the heat path is from the bearing shaft across the liquid metal.

13. A method as claimed in claim 12 wherein the bearing shaft comprises a base that can contain cooling oil.

14. A method as claimed in claim 13 wherein the heat path is into a conduction rod and the cooling oil via conduction and convection.

* * * * *